US009073121B2

(12) United States Patent
Nakamura et al.

(10) Patent No.: US 9,073,121 B2
(45) Date of Patent: Jul. 7, 2015

(54) METHOD FOR PRODUCING SINTERED COMPACT

(75) Inventors: Hidefumi Nakamura, Hachinohe (JP); Hideki Ishigami, Hachinohe (JP)

(73) Assignee: Seiko Epson Corporation (JP)

( * ) Notice: Subject to any disclaimer, the term of this patent is extended or adjusted under 35 U.S.C. 154(b) by 1093 days.

(21) Appl. No.: 13/104,500

(22) Filed: May 10, 2011

(65) Prior Publication Data

US 2011/0280759 A1 Nov. 17, 2011

(30) Foreign Application Priority Data

May 11, 2010 (JP) ..... 2010-109033

(51) Int. Cl.
*B22F 3/14* (2006.01)
*B22F 3/10* (2006.01)

(52) U.S. Cl.
CPC ..... *B22F 3/101* (2013.01)

(58) Field of Classification Search
CPC ..... B22F 3/101
USPC ..... 419/29
See application file for complete search history.

(56) References Cited

U.S. PATENT DOCUMENTS 5,055,128 A * 10/1991 Kiyota et al. ..... 75/246
5,328,657 A * 7/1994 Kamel et al. ..... 419/36
5,490,968 A 2/1996 Polizzotti et al.
6,461,156 B2 10/2002 Kumazawa et al.
2007/0231181 A1 10/2007 Nakamura
2009/0224442 A1 9/2009 Sakata et al.

FOREIGN PATENT DOCUMENTS

| | | |
|---|---|---|
| JP | 2002-145672 | 5/2002 |
| JP | 2004-107772 | 4/2004 |
| JP | 2004-332015 | 11/2004 |
| JP | 2007-277603 | 10/2007 |
| JP | 2009-138259 | 6/2009 |
| JP | 2009-209019 | 9/2009 |
| JP | 2009-291400 | 12/2009 |
| JP | 2009-299106 | 12/2009 |
| JP | 2010-059456 | 3/2010 |
| JP | 2010-084165 | 4/2010 |

* cited by examiner

*Primary Examiner* — Jessee Roe
*Assistant Examiner* — Christopher Kessler
(74) *Attorney, Agent, or Firm* — Harness, Dickey & Pierce, P.L.C.

(57) ABSTRACT

In a method for producing a sintered compact, a composition containing metal powder and an organic binder is formed into a given shape. When baking is performed by using a baking furnace inside of which a jig containing silica is provided, a furnace atmosphere of the baking furnace is set to be an atmosphere of inert gas, a furnace pressure is controlled to be 0.1 kPa or more but 100 kPa or less, and the furnace pressure during baking is increased at a time when the process is in the middle of heating-up.

8 Claims, 2 Drawing Sheets

METHOD FOR PRODUCING SINTERED COMPACT

This application claims priority to Japanese Patent Application No. 2010-109033 filed May 11, 2010 which is hereby expressly incorporation by reference herein in its entirety.

BACKGROUND

1. Technical Field

The present invention relates to methods for producing a sintered compact.

2. Related Art

As a method for producing a compact when a metal product is produced by sintering a compact containing metal powder, metal injection molding (MIM), for example, by which metal powder and an organic binder are mixed and kneaded and injection molding is performed by using the kneaded mixture thus obtained has been known.

The organic binder is removed from the compact produced by MIM by a degreasing treatment (binder removal treatment), and the compact is then baked, whereby a sintered compact is obtained.

When the compact is baked, the brown body is placed inside a baking furnace and is heated under reduced pressure or in the presence of inert gas. As a result, a diffusion phenomenon occurs between particles of the metal powder. This causes gradual densification of the compact and the sintering thereof.

Incidentally, the brown body is put on a tray-shaped jig generally called a "setter", and is placed inside the baking furnace while being put on the setter and is then baked. The setter is formed of ceramic materials such as mullite and has good heat resistance.

JP-A-2002-145672 discloses a ceramic setter formed of ceramic materials containing mullite.

However, when the above-described ceramic setter is repeatedly used in a baking process, the setter deteriorates with time due to oxygen deficiency of the ceramic material. This undesirably causes defects such as a fracture or deformation.

Moreover, an insufficient increase of sintered density of the sintered compact as a result of oxygen deficiency of the ceramic material has also become a problem.

SUMMARY

An advantage of some aspects of the invention is to provide a method for producing a sintered compact, the method enabling the production of a sintered compact with a high sintered density while preventing deterioration of a setter.

A method for producing a sintered compact according to an aspect of the invention includes: a forming process for obtaining a compact by forming a composition containing metal powder and an organic binder into a predetermined shape; and a baking process for obtaining a sintered compact by baking the compact by using a baking furnace inside which a jig containing silica is provided, wherein, in the baking process, a furnace atmosphere of the baking furnace is set so as to be an atmosphere of inert gas, a furnace pressure is set at 0.1 kPa or more but 100 kPa or less, and the furnace pressure is increased during a heating-up process in the baking process.

This makes it possible to produce a sintered compact with a high sintered density while preventing deterioration of a setter.

In the method for producing a sintered compact according to the aspect of the invention, it is preferable that the furnace pressure be increased when a furnace temperature of the baking furnace is 900° C. or more but 1200° C. or less during the heating-up process in the baking process.

This makes it possible to prevent volatilization of SiO and Si and more reliably prevent normal sintering from being inhibited by SiO and Si.

In the method for producing a sintered compact according to the aspect of the invention, it is preferable that the heating-up process in the baking process include a first heating-up process in which the furnace pressure is set at 35 kPa or less and a second heating-up process in which the furnace pressure is set at more than 35 kPa.

This makes it possible to prevent deterioration of a setter and improve the quality of a sintered compact.

In the method for producing a sintered compact according to the aspect of the invention, it is preferable that the furnace pressure be adjusted in the baking process by taking in inert gas into the furnace while exhausting gas inside the furnace.

By doing so, the furnace atmosphere is replaced by another at all times, whereby it is possible to promptly exhaust the gas desorbed from the compact (the brown body) or the furnace wall, for example, to the outside and thereby prevent contamination of the compact (the brown body).

In the method for producing a sintered compact according to the aspect of the invention, it is preferable that the inert gas be gas containing argon as a main ingredient.

Argon is especially weakly-reactive among the inert gases and is relatively inexpensive and easily available. In addition, argon has an advantage in that it is seldom unevenly distributed due to a relatively small difference between air and argon in specific gravity. This makes it possible to prevent the gas released from the compact (the brown body) from remaining at an area around the compact (the brown body) without being dispersed inside the furnace and from re-adhering to the compact (the brown body).

In the method for producing a sintered compact according to the aspect of the invention, it is preferable that the metal powder be stainless steel powder, and the baking conditions in the baking process be controlled so that baking is performed at a maximum temperature of 1000° C. or more but 1400° C. or less for 0.5 hour or more but 8 hours or less.

This makes it possible to prevent the crystalline structure from becoming enlarged more than necessary. As a result, it is possible to obtain a sintered compact having a minute crystalline structure and excellent mechanical and chemical characteristics.

It is preferable that the method for producing a sintered compact according to the aspect of the invention further include a process for performing heating treatment on the jig containing silica under an oxidizing atmosphere after the baking process.

As a result, reduction of $SiO_2$ is suppressed, and SiO and Si generated due to failed suppression of reduction can be re-oxidized. This makes it possible to more reliably prevent deterioration of a setter. In addition, by using the reprocessed setter in the baking process, it is possible to produce a higher-quality sintered compact.

In the method for producing a sintered compact according to the aspect of the invention, it is preferable that a heating temperature in the heating treatment be 1200° C. or more but 1600° C. or less.

This makes it possible to reliably oxidize SiO and Si while preventing deterioration of a setter.

In the method for producing a sintered compact according to the aspect of the invention, it is preferable that the heating treatment be performed under a pressurized atmosphere.

This makes it possible to oxidize SiO and Si while more reliably preventing volatilization of SiO and Si during heating.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
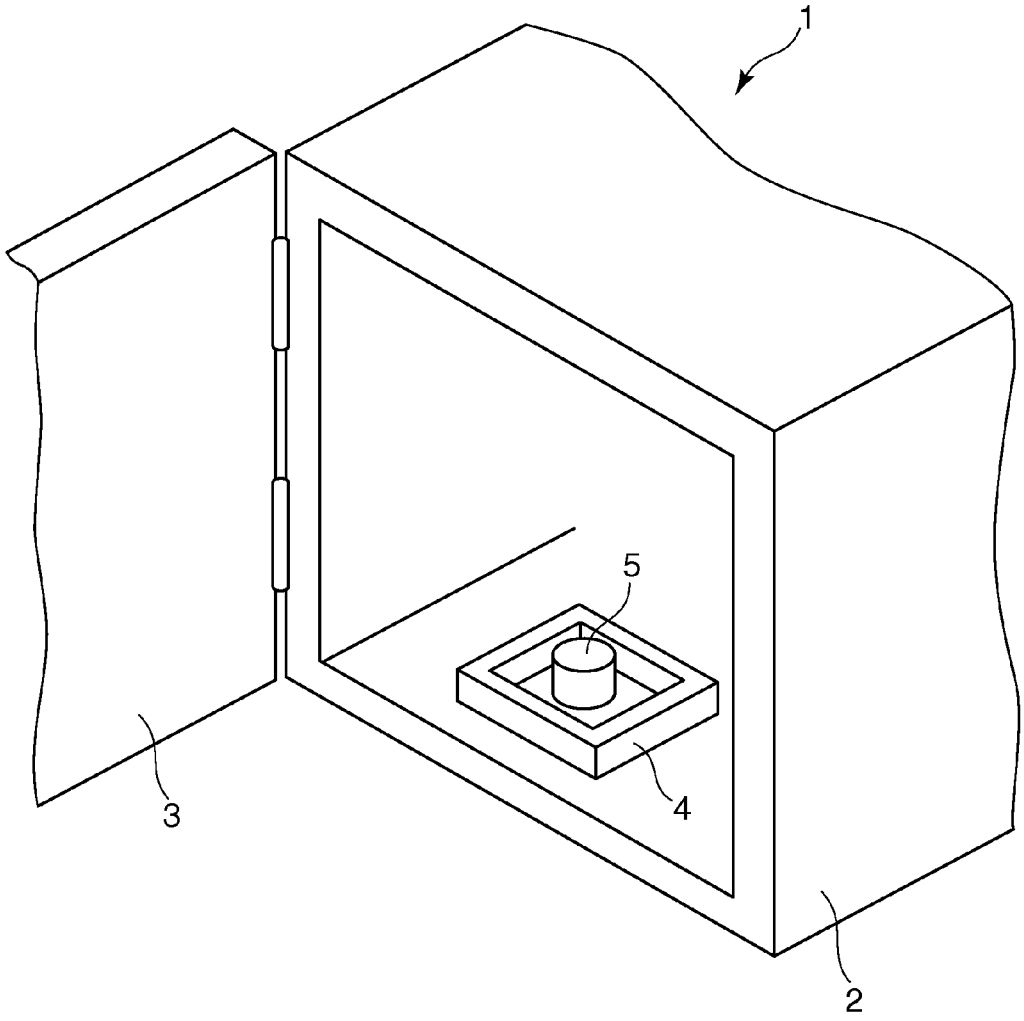
FIG. 1 is a perspective view showing a state in which a brown body put on a setter is placed inside a batch-type baking furnace.

Hereinafter, a preferred embodiment of a method according to an aspect of the invention for producing a sintered compact will be described in detail with reference to the accompanying drawings.

The method according to the aspect of the invention for producing a sintered compact includes a composition-preparing process for preparing a composition containing metal powder and an organic binder, a forming process for obtaining a compact by forming the composition into a predetermined shape, a degreasing process for obtaining a brown body by removing the organic binder from the compact, and a baking process for obtaining a sintered compact by baking the brown body (the compact) by using a baking furnace inside which a setter (a jig) containing $SiO_2$ (silica) is provided.

Then, in the baking process, the furnace atmosphere of the baking furnace is set so as to be an atmosphere of inert gas and the furnace pressure is set at 0.1 kPa or more but 100 kPa or less, and, in a heating-up process in the baking process, an adjustment is made such that the furnace pressure is increased during the process.

With such a method, a reduction of $SiO_2$ in the setter is prevented. This prevents contamination of the brown body (the compact). As a result, it is possible to produce a sintered compact with a high sintered density.

Hereinafter, the processes of the method according to the aspect of the invention for producing a sintered compact will be described step by step.

[1] Composition-Preparing Process

First, metal powder and an organic binder are prepared and are kneaded by a kneader, whereby a kneaded mixture (a composition) is obtained. In the kneaded mixture (the compound), the metal powder is homogenously dispersed.

Moreover, the metal powder and the organic binder which do not bring about chemical reaction between them are preferably used.

Some examples of the metal material forming the metal powder are Mg, Al, Ti, V, Cr, Mn, Fe, Co, Ni, Cu, Zn, Y, Zr, Nb, Mo, Pd, Ag, In, Sn, Ta, W, or an alloy of these metals.

Some examples of the alloy are stainless steel, die steel, high-speed tool steel, low-carbon steel, Permendur, various Fe alloys such as an Fe—Ni alloy and an Fe—Ni—Co alloy, various Ni alloys, and various Cr alloys.

Furthermore, some examples of the stainless steel are SUS304, SUS316, SUS317, SUS329, SUS410, SUS430, SUS440, and SUS630.

In addition, two or more types of metal powder having different compositions may be mixed and used. This also makes it possible to produce a sintered compact with an alloy composition which could not have been produced by casting. Moreover, it is possible to produce a sintered compact having a new function or a plurality of functions easily, making it possible to expand the function and uses of the sintered compact.

Although the average particle size of the metal powder is not limited to a particular size, the average particle size is preferably about 3 μm or more but 30 μm or less, and, more preferably, about 5 μm or more but 20 μm or less. When the average particle size of the metal powder is within the above-described range, the fluidity of a kneaded mixture becomes high, making it possible to obtain a kneaded mixture with good formability (which is readily formable). As a result, the density of a compact is increased in the forming process, whereby a sintered compact with good mechanical characteristics and a high degree of dimensional accuracy can be eventually obtained.

Incidentally, it is difficult to produce metal powder whose average particle size is smaller than the above-described lower limit. Moreover, when the average particle size of the metal powder exceeds the above-described upper limit, there is a possibility that the crystalline structure of the sintered compact becomes large, resulting in poor mechanical characteristics of the sintered compact.

As the metal powder, powder produced by, for example, an atomizing method (for instance, a water atomizing method, a gas atomizing method, and a rapidly-rotating water stream atomizing method), a reduction process, a carbonyl process, and a grinding technique is used. The powder produced by the atomizing method is preferably used. With the atomizing method, it is possible to produce extremely minute metal powder efficiently. As a result, by using such metal powder as raw powder, it is possible to obtain a sintered compact having a fine crystalline structure and high mechanical strength with reliability.

In addition, the metal powder produced by the atomizing method has good dispersibility and fluidity because it is roughly spherical in shape, and also allows the kneaded mixture to be easily charged into a forming die at the time of forming the kneaded mixture into a given shape. Therefore, it is possible to form a compact having an intricate and fine shape with ease in the forming process.

Some examples of the organic binder are polyolefin such as polyethylene, polypropylene, and ethylene-vinyl acetate copolymer, acrylic resin such as polymethyl methacrylate and polybutyl methacrylate, styrene resin such as polystyrene, polyester such as polyvinyl chloride, polyvinylidene chloride, polyamide, polyethylene terephthalate, and polybutylene terephthalate, resins such as polyether, polyvinyl alcohol, or a copolymer thereof, waxes, paraffin, higher fatty acid (for example, stearic acid), higher alcohol, higher fatty acid ester, and higher fatty acid amide, and one or two or more of them can be mixed and used.

Of the above examples, the organic binder containing polyolefin as a main ingredient is preferable. Polyolefin has relatively high degradability by reducing gas. As a result, when polyolefin is used as a main ingredient of the organic binder, it is possible to degrease the compact with reliability in a shorter time.

Moreover, the content of organic binder is preferably about 2 wt % or more but 20 wt % or less of the entire kneaded mixture, and, more preferably, about 5 wt % or more but 10 wt % or less of the entire kneaded mixture. When the content of organic binder is within the above-described range, it is possible to form a compact with good formability and increase the density thereof, and thereby obtain a compact with particularly good shape stability and the like. In addition, when the content of organic binder is within the above-described range, it is possible to reduce a difference between a compact and a brown body, that is, a so-called degree of shrinkage. This makes it possible to increase the dimensional accuracy of a brown body and a sintered compact.

Furthermore, a plasticizer may be added to the kneaded mixture. Some examples of the plasticizer are phthalate ester (for example, DOP, DEP, and DBP), adipic acid ester, trimellitic acid ester, and sebacic acid ester, and one or two or more of them can be mixed and used.

Further, in addition to the metal powder, the organic binder, and the plasticizer, additives such as an antioxidant, a degreasing accelerating agent, and a surface-active agent may be added to the kneaded mixture as needed.

The kneading conditions vary according to various conditions such as the composition and the particle size of the metal powder, the composition of the organic binder, and a ratio of combination of the metal powder and the organic binder. One example of the conditions is that the kneading temperature is about 50° C. or more but 200° C. or less and the kneading time is about 15 minutes or more but 210 minutes or less.

Moreover, the kneaded mixture is turned into pellets (small lumps) if necessary. The particle size of a pellet is set at about 1 mm or more but 15 mm or less, for example.

Incidentally, a composition containing metal powder and an organic binder may be in the form of granulated powder produced by various granulation methods, not in the form of a kneaded mixture. Such a form is appropriately selected according to the forming method in the forming process.

[2] Forming Process

Next, the kneaded mixture is formed into a given shape, whereby a compact of the same shape as that of an intended sintered compact is produced.

A method for producing a compact (a forming method) is not limited to a particular method. Some examples of the method are metal injection molding (MIM), compression molding (powder compacting molding), extrusion molding. Of these methods, metal powder injection molding is preferable.

MIM makes it possible to produce a relatively small compact and a compact having an intricate and fine shape in a near net shape (a shape close to a final shape), and has an advantage in that it can fully utilize the characteristics of the used metal powder. As a result, in applying the invention, it is possible to obtain a compact which makes effective use of the effects thereof.

Hereinafter, as an example of the forming method, production of a compact by using MIM will be described.

First, injection molding is performed by an injection machine by using the kneaded mixture obtained in the composition-preparing process, whereby a compact having an intended shape and dimensions is produced. In this case, it is possible to produce a compact having an intricate shape with ease by selecting an appropriate forming die.

The compact thus obtained is formed of the organic binder in which the metal powder is dispersed nearly homogenously.

Incidentally, the shape and the dimensions of a compact to be produced are determined, allowing for shrinkage of the compact due to degreasing and sintering which will be performed subsequently.

The forming conditions in injection molding vary according to various conditions such as the composition and the particle size of the metal powder used, the composition of the organic binder, and a ratio of combination of the metal powder and the organic binder. One example of the conditions is that the material temperature is preferably about 80° C. or more but 200° C. or less and the injection pressure is preferably 2 MPa or more but 30 MPa or less (20 kgf/cm$^2$ or more but 300 kgf/cm$^2$ or less).

[3] Degreasing Process

Degreasing treatment (binder removal treatment) is performed on the compact obtained in the forming process, whereby a brown body is obtained.

The degreasing treatment is performed by carrying out heat treatment in, for example, the atmosphere, an atmosphere containing oxidizing gas such as air and oxygen, reducing gas such as hydrogen and carbon monoxide, inert gas such as nitrogen, helium, and argon, and mixed gas containing one or two or more of these gases, or a reduced pressure atmosphere.

In this case, although the conditions of the heat treatment slightly vary according to the degradation start temperature of the organic binder, the conditions are that the heat treatment is carried out preferably at a temperature of about 100° C. or more but 750° C. or less for about 0.5 hour or more but 40 hours or less, and, more preferably, at a temperature of about 150° C. or more but 600° C. or less for about 1 hour or more but 24 hours or less.

The degreasing by such heat treatment may be performed in a plurality of processes (stages) for various purposes (for example, for shortening the degreasing time). In this case, some examples of the method are a method in which degreasing is performed at a low temperature in the first half of the process and performed at a high temperature in the latter half of the process and a method in which degreasing is performed at a low temperature and a high temperature alternately. Moreover, when degreasing is performed and baking is then performed in the baking process which will be described later, the above-described process in which only degreasing is performed can be omitted.

Furthermore, the degreasing treatment may be performed by making a particular component in the organic binder or additive agent elute by using a predetermined solvent (fluid such as liquid or gas).

Incidentally, the organic binder may not be removed completely by the degreasing treatment. For example, part of the organic binder may be left when the degreasing treatment is completed.

By forming a brown body in the manner described above, it is possible to obtain a brown body with a high level of ability to maintain the shape thereof (shape retention).

[4] Baking Process

The brown body obtained in the degreasing process is baked in a baking furnace or the like. By doing so, the brown body is sintered, whereby a sintered compact is obtained.

As a result of this sintering, dispersion occurs at an interface between the particles of the metal powder, causing grain growth, whereby a crystalline structure is formed. As a result, it is possible to obtain a sintered compact which is closely packed and high-density as a whole.

Some examples of the type of the baking furnace are a continuous-type furnace and a batch-type furnace. However, the type of the baking furnace is not limited to a particular type. At the time of baking, the brown body is put on a tray-shaped setter and is placed inside the baking furnace while being put on the setter.

FIG. 1 is a perspective view showing a state in which a brown body put on a setter is placed inside a batch-type baking furnace.

A baking furnace 1 shown in FIG. 1 includes a box-shaped housing 2 and a lid body 3 which is provided so as to cover one side of the housing 2 and can open and close the inside space of the housing 2.

Inside the housing 2, a heater (not shown) is placed. With this heater, it is possible to heat the inside of the housing 2.

Moreover, the housing 2 is provided with an exhaust unit (not shown) which exhausts gas inside the housing 2 to the outside and an air supply unit (not shown) which takes in gas into the housing 2. The exhaust unit and the air supply unit make it possible to control the composition and the pressure of the internal atmosphere of the housing 2 so as to be intended composition and pressure.

As the exhaust unit, in addition to a forced exhaust unit such as an air displacement pump, a voluntary exhaust unit such as a simple leak valve is also used. Moreover, some examples of the air supply unit are a gas cylinder and a gas tank.

Inside the housing 2 shown in FIG. 1, a tray-shaped setter 4 is provided, and a brown body 5 is placed on the setter 4.

At the time of baking, after the inside of the housing 2 is brought into a sealed state by closing the lid body 3, the brown body 5 is heated while being put on the setter 4 and undergoes sintering.

The setter used at the time of baking of the brown body is, in general, a tray-shaped container formed of ceramic materials containing $SiO_2$, such as mullite. Since ceramic containing $SiO_2$ has high heat resistance and high impact resistance, it is possible to prevent a fracture or deformation, of the setter with reliability in the baking process in which the setter is heated at high temperature. As a result, such a setter is useful because the setter can be repeatedly used in the baking process.

While the above-described setter has the advantage described above, the setter deteriorates with time when used in the baking process under, in particular, a non-oxidizing atmosphere such as under reduced pressure, under an atmosphere of reducing gas, and under an atmosphere of inert gas, causing defects such as a fracture or deformation.

The inventor of the invention has carried out studies on the mechanism of deterioration of a setter (a jig) containing $SiO_2$ (silica).

As a result, the inventor has found that $SiO_2$ contained in the setter tends to be reduced when baking is performed under a non-oxidizing atmosphere, and a carbon in the brown body, the carbon generated as a result of carbonization of the organic binder, unites with oxygen of $SiO_2$ and $SiO_2$ is reduced to SiO. Since SiO is highly volatile as compared to $SiO_2$, SiO is scattered in the baking furnace at the time of baking and is likely to attach to the surface of the compact. The inventor has revealed that, when a silicon substance such as SiO attaches to the surface of the compact, the compact is contaminated, inhibiting normal sintering. In particular, since volatilization of the silicon substance is promoted when baking is performed under reduced pressure, the above problem occurs.

Moreover, when reduction of $SiO_2$ occurs, the composition of the ceramic forming the setter changes. Since the setter is repeatedly used, it is considered that $SiO_2$ in the setter gradually decreases every time the setter is used in baking, lowering the mechanical characteristics of the setter.

Based on the above mechanism, the inventor has found out desired conditions inside the baking furnace and has found that a high-quality sintered compact can be produced while preventing deterioration of a setter by performing baking under these conditions, and has completed the invention.

The conditions which the inventor has found out are that the furnace atmosphere of the baking furnace is set so as to be an atmosphere of inert gas, the furnace pressure is set at 0.1 kPa or more but 100 kPa or less, and in a heating-up process in the baking process, an adjustment is made such that the furnace pressure is increased during the process.

When the brown body is baked under such conditions, reduction of $SiO_2$ is suppressed, and deterioration of the metal powder in the composition can be prevented. This makes it possible to prevent deterioration of the setter and improve the quality of the sintered compact.

Moreover, by setting the furnace atmosphere so as to be an atmosphere of inert gas, reduction of $SiO_2$ and oxidation of the metal powder are suppressed because the atmosphere is not a reducing atmosphere.

Incidentally, when the furnace pressure becomes less than the above-described lower limit, SiO and Si particularly tend to be volatile, inhibiting normal sintering. On the other hand, when the furnace pressure increases, while volatilization of SiO and Si is suppressed, the oxygen partial pressure inside the furnace increases relative to an increase in the furnace pressure. Then, when the furnace pressure exceeds the above-described upper limit, oxidation of the metal powder is particularly promoted, causing oxidation of the sintered compact.

Moreover, by making an adjustment such that the furnace pressure is increased during the heating-up process at the time of baking, it is possible to prevent deterioration of the setter and improve the quality of the sintered compact.

Some examples of the above-described inert gas are nitrogen, helium, and argon. Among them, argon is particularly preferably used because argon is especially weakly-reactive among the inert gases and is relatively inexpensive and easily available. In addition, argon has an advantage in that it is seldom unevenly distributed due to a relatively small difference between air and argon in specific gravity. This makes it possible to prevent the gas released from the brown body from remaining at an area around the brown body without being dispersed inside the furnace and from re-adhering to the brown body.

Furthermore, mixed gas containing these gases as a main ingredient may be used as desired. In this case, it is preferable that the concentration of inert gas in the mixed gas be 80% by volume or more.

Moreover, as described earlier, the furnace pressure at the time of baking is set at 0.1 kPa or more but 100 kPa or less (0.75 Torr or more but 750 Torr or less); preferably, the furnace pressure at the time of baking is set at 0.5 kPa or more but 50 kPa or less (3.75 Torr or more but 375 Torr or less).

Figures 2A, 2B:
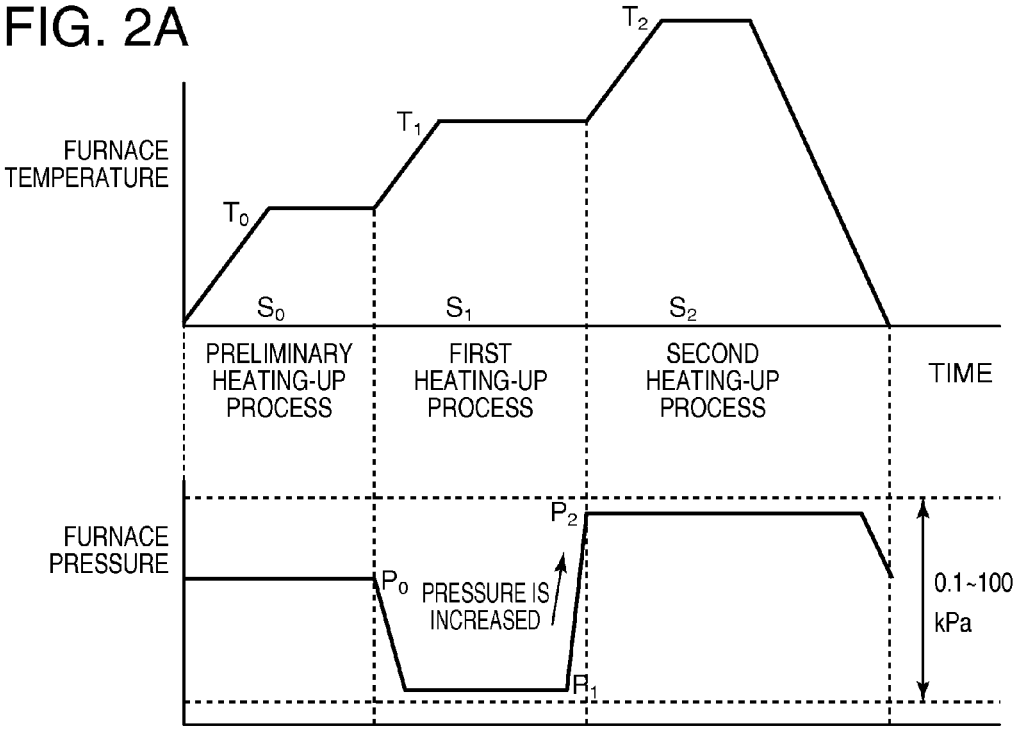
FIGS. 2A and 2B are graphs showing an example of variations in the furnace temperature with time and an example of variations in the furnace pressure with time in a baking process.

Here, an example of variations in the furnace temperature with time and an example of variations in the furnace pressure with time in the baking process are shown in FIGS. 2A and 2B. The baking process will be described in detail with reference to FIGS. 2A and 2B.

In this embodiment, descriptions will be given by taking up, as an example of the baking process, a case in which the heating-up process of the baking process is divided broadly into three heating-up processes: a preliminary heating-up process $S_0$, a first heating-up process $S_1$, and a second heating-up process $S_2$.

Preliminary Heating-up Process $S_0$

First, in the preliminary heating-up process $S_0$, the temperature is gradually raised from ambient temperature and is kept at a constant temperature $T_0$, whereby the organic binder remaining in the brown body is reliably removed.

The temperature $T_0$ in the preliminary heating-up process $S_0$ simply has to be set at a temperature at which the organic binder is degradable, and it is preferable that the temperature $T_0$ be 500° C. or more but 700° C. or less, for example.

Moreover, although the time for which the temperature is kept at the temperature $T_0$ is appropriately set according to the temperature $T_0$, the time is preferably 0.5 hour or more but 8 hours or less, for example, and, more preferably, 1 hour or more but 4 hours or less.

In addition, the furnace pressure $P_0$ in the preliminary heating-up process $S_0$ is not limited to a particular pressure, and simply has to be 0.1 kPa or more but 100 kPa or less.

Incidentally, the preliminary heating-up process $S_0$ may be provided as needed. When there are few organic binders remaining in the brown body to be subjected to the baking process, the preliminary heating-up process $S_0$ can be omitted. Moreover, even if the preliminary heating-up process $S_0$ is provided or not provided, the organic binder is not removed completely, and a constituent element, such as carbon, of the organic binder remains.

First Heating-up Process $S_1$

Next, the furnace temperature is gradually increased and is kept at a constant temperature $T_1$.

The temperature $T_1$ in the first heating-up process $S_1$ is higher than the temperature $T_0$. The temperature $T_1$ is preferably 900° C. or more but 1200° C. or less, and, more preferably, 950° C. or more but 1150° C. or less. By setting the temperature $T_1$ within the above-described range, it is possible to unite the carbon remaining in the brown body and the oxide which is present on the surface of each particle of the metal powder efficiently. As a result, reduction of the oxide progresses, and the oxygen content in the brown body is lowered. In this state, the metal powder is efficiently sintered, and a high-density sintered compact is eventually obtained.

Incidentally, it is preferable that a difference between the temperature $T_1$ and the temperature $T_0$ be 200° C. or more but 400° C. or less.

Moreover, although the time for which the temperature is kept at the temperature $T_1$ is appropriately set according to the temperature $T_1$, the time is preferably 0.5 hour or more but 8 hours or less, for example, and, more preferably, 1 hour or more but 4 hours or less.

Furthermore, as the process proceeds to the first heating-up process $S_1$, the pressure inside the furnace is reduced, whereby the furnace pressure is reduced to $P_1$.

As described above, in the first heating-up process $S_1$, by relatively reducing the furnace pressure, it is possible to suppress oxidation of the metal powder with reliability. In particular, by reducing the furnace pressure to $P_1$, it is possible to remove air, carbon dioxide, and moisture, remaining in the brown body efficiently. This contributes to an improvement of the sintered density of the sintered compact. In addition, in this temperature region, $SiO_2$ is still seldom reduced, and there is little possibility of volatilization of SiO and Si. As a result, it is possible to prevent contamination with SiO and Si even if the furnace pressure is reduced to $P_1$.

Incidentally, the operation for reducing the pressure inside the furnace may be performed at the final stage of the preliminary heating-up process $S_0$, or may be performed during the transition from the preliminary heating-up process $S_0$ to the first heating-up process $S_1$.

Moreover, it is preferable that the furnace pressure $P_1$ in the first heating-up process $S_1$ be 35 kPa or less. This makes it possible to more reliably suppress the oxidation reaction of the metal powder in the first heating-up process $S_1$ and prevent a reduction in the quality of the sintered compact.

Furthermore, after the furnace pressure is kept at $P_1$, the furnace pressure is increased at the final stage of the first heating-up process $S_1$. Although reduction of $SiO_2$ tends to proceed in a high-temperature region, volatilization of SiO and Si is suppressed by increasing the furnace pressure relatively. In particular, a temperature around the above-mentioned temperature $T_1$ is a temperature at which not only metallic oxide reduction efficiency is comparatively high, but also reduction of $SiO_2$ begins. As a result, by increasing the furnace pressure at the final stage of the first heating-up process $S_1$, it is possible to reliably prevent SiO and Si which inhibit subsequent sintering from being generated in the brown body whose oxygen content has been sufficiently lowered.

Incidentally, the operation for increasing the pressure inside the furnace may be performed at an initial stage of the second heating-up process $S_2$ which will be described later, or may be performed during the transition from the first heating-up process $S_1$ to the second heating-up process $S_2$.

As a result of the pressure-increasing operation described above, the furnace pressure becomes $P_2$ and is kept at this pressure.

It is preferable that the furnace pressure $P_2$ after the pressure-increasing operation be more than 35 kPa. By controlling the furnace pressure inside the furnace in the manner described above, it is possible to prevent deterioration of the setter and improve the quality of the sintered compact. That is, before the pressure is increased (35 kPa or less), oxidation reaction of the metal powder is more reliably suppressed, making it possible to prevent a reduction in the quality of the sintered compact. On the other hand, after the pressure is increased (more than 35 kPa), volatilization of SiO and Si which inhibit sintering is more reliably suppressed, making it possible to perform normal sintering.

Incidentally, although a difference between the furnace pressure $P_1$ at which the pressure is kept in the first heating-up process $S_1$ and the furnace pressure $P_2$ at which the pressure is kept in the second heating-up process $S_2$ is not limited to a particular value, the difference is preferably 10 kPa or more but 100 kPa or less, and, more preferably, 20 kPa or more but 80 kPa or less.

Moreover, when the furnace pressure is increased from $P_1$ to $P_2$, it is preferable that the pressure-increasing operation be performed when the furnace temperature is within a temperature range of 900° C. or more but 1200° C. or less. This temperature range has been found out by the inventor to be a temperature range in which reduction of the metal powder is completed overlaps a temperature range in which SiO and Si start volatilizing. Based on this temperature range, in this aspect of the invention, by increasing the furnace pressure in this temperature range during the heating-up process in the baking process, it is possible to more reliably prevent normal sintering from being inhibited.

Incidentally, the above-described temperature range is more preferably 950° C. or more but 1150° C. or less.

Second Heating-up Process $S_2$

Next, the furnace temperature is further increased and is kept at a constant temperature $T_2$.

The temperature (the baking temperature) $T_2$ in the second heating-up process $S_2$ is higher than the above temperature $T_1$ and is a maximum temperature in the baking process. Although the temperature $T_2$ is appropriately set according to the composition of the metal powder, when stainless steel powder, for example, is used, the temperature $T_2$ is preferably 1000° C. or more but 1400° C. or less, and, more preferably, 1100° C. or more but 1300° C. or less. By baking the brown body at such a temperature, it is possible to prevent the crystalline structure from becoming enlarged more than necessary. As a result, it is possible to obtain a sintered compact having a minute crystalline structure and excellent mechanical and chemical characteristics.

Incidentally, when the baking temperature becomes less than the above-described lower limit, sintering is sufficiently performed in all or part of the brown body. As a result, there is a possibility that the mechanical characteristics or surface roughness of the obtained sintered compact are lowered. On the other hand, when the baking temperature exceeds the above-described upper limit, sintering progresses more than necessary, and the crystalline structure becomes enlarged. As a result, there is a possibility that the mechanical characteristics of the obtained sintered compact are lowered.

Moreover, it is preferable that a difference between the temperature $T_2$ and the temperature $T_2$ be 100° C. or more but 400° C. or less.

Furthermore, although the baking time is appropriately set according to the baking temperature, the baking time is preferably 0.5 hour or more but 8 hours or less, for example, and, more preferably, 1 hour or more but 4 hours or less.

On the other hand, by setting the furnace pressure $P_2$ at which the temperature is kept in the second heating-up process $S_2$ at more than 35 kPa as described above, it is possible to reliably suppress reduction of $SiO_2$ even if the furnace temperature $T_2$ is high. This makes it possible to prevent atomic diffusion between the particles from being inhibited as a result of SiO and Si generated by the above-described reduction attaching to the surface of the metal powder. As a result, it is possible to perform normal sintering and thereby produce a high-density sintered compact.

By performing the baking process described above, it is possible to produce a high-quality sintered compact with a high sintered density while preventing deterioration of the setter.

Incidentally, in this aspect of the invention, as described earlier, the baking furnace including the exhaust unit which exhausts gas inside the furnace to the outside and the air supply unit which takes in gas into the furnace is preferably used.

As a result of the operations of the exhaust unit and the air supply unit being controlled in a coordinated manner as needed, it is possible to set the furnace pressure at an intended pressure. By doing so, the furnace atmosphere is replaced by another at all times, whereby it is possible to promptly exhaust the gas desorbed from the brown body or the furnace wall to the outside and thereby prevent contamination of the brown body.

[5] Setter Reprocessing Process

Moreover, reprocessing may be performed on the setter if necessary so as to render the used setter reusable.

With the baking process described above, although volatilization of SiO and Si is suppressed, it is impossible to prevent reaction by which $SiO_2$ in the setter is reduced to SiO and Si. As a result, volatile SiO remains in the setter.

However, since the setter is repeatedly used in the baking process, SiO remaining in the setter gradually volatilizes every time the setter is used in the baking process, and SiO in the setter disappears eventually. In this state, the mechanical characteristics and heat resistance and impact resistance of the setter are impaired, resulting in defects such as a fracture or deformation.

Therefore, in this aspect of the invention, reprocessing is performed on the setter after the baking process.

Reprocessing of the setter is performed by carrying out heating treatment on the setter after the baking process under an oxidizing atmosphere. By doing so, SiO in the setter is oxidized back into $SiO_2$. As a result, volatile SiO changes into $SiO_2$ which is relatively less volatile, and the setter is stabilized. That is, by performing reprocessing, reduction of $SiO_2$ is suppressed, and SiO generated due to failed suppression of reduction can be re-oxidized. This makes it possible to more reliably prevent deterioration of the setter. In addition, by using the reprocessed setter in the baking process, it is possible to produce a higher-quality sintered compact.

The heating temperature in this heating treatment is preferably 1200° C. or more but 1600° C. or less, and, more preferably, 1300° C. or more but 1500° C. or less. By setting the heating temperature within the above-described range, it is possible to reliably oxidize SiO while preventing deterioration of the setter.

Moreover, although the heating time is appropriately set according to the heating temperature, the heating time is preferably 0.5 hour or more but 8 hours or less, for example, and, more preferably, 1 hour or more but 4 hours or less.

Some examples of the oxidizing atmosphere under which the heating treatment is performed are an oxygen gas atmosphere and the atmosphere.

Moreover, the heating treatment is performed preferably under a pressurized atmosphere. Under a pressurized atmosphere, it is possible to oxidize SiO while more reliably preventing volatilization of SiO during heating.

The pressure of the atmosphere under which the heating treatment is performed simply has to be more than an atmospheric pressure. The pressure of the atmosphere under which the heating treatment is performed is preferably set at 150 kPa or more, and, more preferably, set at 200 kPa or more. By performing the heating treatment at such a pressure, since volatilization of SiO is more reliably suppressed, it is possible to prevent deterioration of the setter sufficiently.

In this way, the setter can be reprocessed into a reusable setter.

Although the method according to the aspect of the invention for producing a sintered compact has been described based on the preferred embodiment, the invention is not limited to the embodiment described above.

EXAMPLES

1. Production of Sintered Compact

Example 1

[1] First, Permendur powder (manufactured by Epson Atmix Corporation) having an average particle size of 10 μm and a mixture (an organic binder) of polypropylene and wax were weighed such that a mass ratio between them became 9:1 and were then mixed, whereby mixed raw material (a composition) was obtained.

[2] Next, the mixed raw material was kneaded by a kneader, whereby a compound was obtained.

[3] Then, the compound was formed into a given shape by an injection machine under the following forming conditions, whereby a compact was produced.

Forming Conditions

Material temperature: 150° C.

Injection pressure: 11 MPa (110 kgf/cm$^2$)

[4] Next, heat treatment (degreasing treatment) was carried out on the compact thus obtained under the following degreasing conditions, whereby a brown body was obtained.

Degreasing Conditions

Heating temperature: 500° C.

Heating time: 2 hours

Heating atmosphere: nitrogen gas

[5] Next, the brown body thus obtained was put on a tray-shaped setter (made of mullite ceramic) and was placed inside a batch-type baking furnace while being put on the tray. Then, the brown body was baked under the following baking conditions, whereby a sintered compact was obtained. Incidentally, the baking furnace used is configured so that the furnace pressure can be kept constant as a result of an air displacement pump and a gas cylinder being connected and respectively exhausting and supplying air continuously at all times.

Baking Conditions

Preliminary Heating-Up Process

Furnace temperature $T_0$: 600° C.×1 hour

Furnace pressure $P_0$: 70 kPa

Furnace atmosphere: argon gas (100%)

First Heating-Up Process

Furnace temperature $T_1$: 1000° C.×1 hour

Furnace pressure $P_1$: 30 kPa

Furnace atmosphere: argon gas (100%)

Second Heating-Up Process

Furnace temperature $T_2$: 1200° C. (baking temperature)×3 hours

Furnace pressure $P_2$: 100 kPa

Furnace atmosphere: argon gas (100%)

Examples 2 to 8

Sintered compacts were obtained in the same manner as in Example 1 except that the baking conditions were changed as shown in Table 1.

Comparative Examples 1 to 4

Sintered compacts were obtained in the same manner as in Example 1 except that the baking conditions were changed as shown in Table 1.

Comparative Example 5

A sintered compact was obtained in the same manner as in Example 1 except that baking was performed under the following baking conditions without increasing the furnace pressure during the heating-up process.

Baking Conditions

Furnace temperature $T_1$: 1200° C.×3 hours

Furnace pressure $P_1$: 30 kPa

Furnace atmosphere: argon gas (100%)

Comparative Example 6

A sintered compact was obtained in the same manner as in Example 1 except that the furnace atmosphere was changed to nitrogen gas (100%).

2. Evaluation of Sintered Compact 2.1 Sintered Density Measurement

The sintered densities of the sintered compacts obtained in the examples and the comparative examples were measured. Incidentally, sintered density measurement was made by a method based on the Archimedean method (specified in JIS Z 2501).

Then, the measured sintered densities were evaluated based on the following evaluation criteria.

Evaluation Criteria for Sintered Density

A: Sintered density is 8.1 g/cm$^3$ or more.

B: Sintered density is 8.05 g/cm$^3$ or more but less than 8.1 g/cm$^3$.

C: Sintered density is 8.0 g/cm$^3$ or more but less than 8.05 g/cm$^3$.

D: Sintered density is less than 8.0 g/cm$^3$.

Moreover, based on the measured sintered densities and the real densities of different steel types, the relative densities of the examples and the comparative examples were calculated.

2.2 Oxygen Content Measurement

The oxygen contents of the sintered compacts obtained in the examples and the comparative examples were measured by the oxygen/nitrogen determinator (TC-300 manufactured by LECO Corporation).

Then, the measured oxygen contents were evaluated based on the following evaluation criteria.

Evaluation Criteria for Oxygen Content

A: Oxygen content is particularly low.

B: Oxygen content is rather low.

C: Oxygen content is rather high.

D: Oxygen content is particularly high.

The evaluation results of 2.1 and 2.2 are shown in Table 1.

TABLE 1

| | Baking conditions | | | | | | Evaluation results of sintered compacts | |
|---|---|---|---|---|---|---|---|---|
| | First heating-up process | | | Second heating-up process | | | | |
| | Furnace temperature ° C. | Furnace pressure kPa | Furnace atmosphere — | Furnace temperature ° C. | Furnace pressure kPa | Furnace atmosphere — | Sintered density — | Oxygen content — |
| Example 1 | 1000 | 30 | Ar | 1200 | 100 | Ar | A | A |
| Example 2 | 1000 | 30 | Ar | 1200 | 70 | Ar | A | A |
| Example 3 | 1000 | 30 | Ar | 1200 | 40 | Ar | B | A |
| Example 4 | 1000 | 10 | Ar | 1200 | 100 | Ar | A | A |
| Example 5 | 1000 | 1 | Ar | 1200 | 10 | Ar | B | A |
| Example 6 | 1000 | 0.1 | Ar | 1200 | 1 | Ar | B | A |
| Example 7 | 1170 | 30 | Ar | 1200 | 100 | Ar | B | B |
| Example 8 | 900 | 30 | $N_2$ | 1200 | 100 | $N_2$ | B | B |
| Comparative Example 1 | 1000 | 0.001 | Ar | 1200 | 0.01 | Ar | C | A |
| Comparative Example 2 | 1000 | 0.01 | Ar | 1200 | 0.01 | Ar | C | A |
| Comparative Example 3 | 1000 | 200 | Ar | 1200 | 200 | Ar | C | C |
| Comparative Example 4 | 1000 | 30 | $H_2$ | 1200 | 100 | $H_2$ | D | A |
| Comparative Example 5 | 1200 | 30 | Ar | — | — | — | D | A |

TABLE 1-continued

| | Baking conditions | | | | | | Evaluation results of sintered compacts | |
|---|---|---|---|---|---|---|---|---|
| | First heating-up process | | | Second heating-up process | | | | |
| | Furnace temperature ° C. | Furnace pressure kPa | Furnace atmosphere — | Furnace temperature ° C. | Furnace pressure kPa | Furnace atmosphere — | Sintered density — | Oxygen content — |
| Comparative Example 6 | 1200 | 30 | $N_2$ | — | — | — | D | B |

As is clear from Table 1, the sintered compacts obtained in the examples have higher sintered densities and lower oxygen contents as compared to the sintered compacts obtained in the comparative examples.

Moreover, it is considered that, in Example 8, the sintered density was not increased significantly because removal of carbon in the brown body was not performed successfully due to a slightly low furnace temperature $T_1$ in the first heating-up process.

In addition, it is considered that, in Comparative Example 3, the oxygen content became high due to a high furnace pressure, whereby the sintered density was not increased.

Furthermore, it is considered that, in Comparative Example 4, generation of SiO was promoted as a result of baking having been performed under an atmosphere of reducing gas, whereby sintering was inhibited.

3. Reprocessing of Setter

Reprocessing was performed on the setter used for production of the sintered compacts under the following processing conditions.

Reprocessing Conditions

Heating temperature: 1400° C.×3 hours

Heating atmosphere: atmosphere (air atmosphere) (200 kPa)

4. Evaluation of Setter

The three-point bending strength and the heat resistance and impact resistance of the setter which had undergone the above-described reprocessing and the setter which had not undergone the reprocessing, the setters which were repeatedly used in the baking process 20 times under the baking conditions of Example 1, were evaluated.

The results have revealed that the setter which had undergone the reprocessing had good three-point bending strength and good heat resistance and impact resistance as compared to the setter which had not undergone the reprocessing.

Moreover, when a sintered compact was produced by using the setter which had undergone the reprocessing in the same manner as in Example 1, a sintered compact having a sintered density higher than the evaluation result of Example 1 was obtained.

What is claimed is:

1. A method for producing a sintered compact, comprising:

a forming process for obtaining a compact by forming a composition containing metal powder and an organic binder into a predetermined shape; and a baking process for obtaining a sintered compact by baking the compact by using a baking furnace inside which a jig containing silica is provided, wherein in the baking process, a furnace atmosphere of the baking furnace is set to be an atmosphere of inert gas, a furnace pressure is controlled to be 0.1 kPa or more but 100 kPa or less, and the furnace pressure is increased during a heating-up process of the baking process;

the furnace pressure is adjusted in the baking process by taking inert gas into the furnace while exhausting gas inside the furnace, the metal powder is stainless steel powder, and the baking process is performed at a maximum temperature of 1000° C. or more but 1400° C. or less for 0.5 hour or more but 8 hours or less.

2. The method for producing a sintered compact according to claim 1, wherein a time when the furnace pressure is increased is when a furnace temperature of the baking furnace is 900° C. or more but 1200° C. or less.

3. The method for producing a sintered compact according to claim 1, wherein the heating-up process of the baking process includes a first heating-up process in which the furnace pressure is controlled to be 35 kPa or less and a second heating-up process in which the furnace pressure is controlled to be more than 35 kPa.

4. The method for producing a sintered compact according to claim 1, wherein the atmosphere of inert gas contains argon as a main ingredient.

5. The method for producing a sintered compact according to claim 1, further comprising:

a process for performing a heating treatment on the jig containing silica under an oxidizing atmosphere after the baking process.

6. The method for producing a sintered compact according to claim 5, wherein a heating temperature in the heating treatment is 1200° C. or more but 1600° C. or less.

7. The method for producing a sintered compact according to claim 5, wherein the heating treatment is performed while a pressure is above atmospheric pressure.

8. A method for producing a sintered compact, comprising:

a forming process for obtaining a compact by forming a composition containing metal powder and an organic binder into a predetermined shape;

a baking process for obtaining a sintered compact by baking the compact by using a baking furnace inside which a jig containing silica is provided; and a process for performing a heating treatment on the jig containing silica under an oxidizing atmosphere after the baking process, wherein in the baking process, a furnace atmosphere of the baking furnace is set to be an atmosphere of inert gas, a furnace pressure is controlled to be 0.1 kPa or more but 100 kPa or less, the furnace pressure is increased during a heating-up process of the baking process, and the furnace pressure is adjusted in the baking process by taking inert gas into the furnace while exhausting gas inside the furnace.

* * * * *